US006501452B1

(12) United States Patent
Weng et al.

(10) Patent No.: US 6,501,452 B1
(45) Date of Patent: Dec. 31, 2002

(54) METHOD FOR AUTOMATICALLY ADJUSTING SAMPLING PHASE OF LCD CONTROL SYSTEM

(75) Inventors: Jen-chung Weng, Hsinchu (TW); Wei-chen Sue, Tainan (TW); Tsung-yi Tseng, Ping Tung (TW)

(73) Assignee: Myson Technology, Inc., Hsinchu (TW)

( * ) Notice: Subject to any disclaimer, the term of this patent is extended or adjusted under 35 U.S.C. 154(b) by 0 days.

(21) Appl. No.: 09/492,250

(22) Filed: Jan. 27, 2000

(51) Int. Cl.[7] ..... G09G 3/36
(52) U.S. Cl. ..... 345/89; 345/87
(58) Field of Search ..... 345/87, 89, 90, 345/92, 93; 349/39, 41, 42, 46

(56) References Cited

U.S. PATENT DOCUMENTS 4,745,406 A * 5/1988 Hayashi ..... 345/89
5,619,225 A * 4/1997 Hashimoto ..... 345/98

* cited by examiner

*Primary Examiner*—Vijay Shankar
(74) *Attorney, Agent, or Firm*—Oppenheimer Wolff & Donnelly LLP

(57) ABSTRACT

This invention provides a method for automatically adjusting the sampling phase of a LCD control system. This method uses a special function to compute the image characteristic values under different sampling phases and to select the sampling phase with the largest image characteristic value as the correct sampling phase. The function is $$C = \sum_{i=0}^{n} |2P_i - P_{i-1} - P_{i+1}|,$$

where C denotes the image characteristic value, i's are image points, and $P_i$ are the gray scale values of the corresponding image points.

1 Claim, 4 Drawing Sheets

METHOD FOR AUTOMATICALLY ADJUSTING SAMPLING PHASE OF LCD CONTROL SYSTEM

BACKGROUND OF THE INVENTION

1. Field of Invention

The present invention relates to a method for automatically adjusting the sampling phase of a LCD control system.

2. Related Art

Due to the tremendous progress in the thin film transistor (TFT), the liquid crystal display (LCD) using this technology of TFT is also popular. However, since the LCD is a digital display, the analogue video signals output from the video card has to be converted into digital ones for displaying when it connects to a usual personal computer (PC). Therefore, an analogue to digital converter (ADC) is needed between the LCD and the video card. The main parameters that control the ADC are the sampling frequency and the sampling phase. The precision of them has a great influence on the sampling signals of the ADC, which in turn affects the image quality. Thus, only the correct sampling frequency and sampling phase are used can one get correct image values.

Currently, the methods for finding the best sampling phase include the method of calculation in the frequency domain and the method of calculating the maximum sum of difference in the time domain. The method of maximum sum of difference is to sample an image by ADC under some different sampling phases, to sum the absolute values of the gray scale difference between adjacent two points for each sampling phase as the image characteristic value, and to select the sampling phase with largest image characteristic value as the correct sampling phase. The summation is done by using Equation (1):

$$C = \sum_{i=1}^{n} |P_{i+1} - P_i| \tag{1}$$

Nevertheless, when computing the image characteristic value with Equation (1), it is possible to set an incorrect sampling phase. For example, FIGS. 2, 3 and 4 show schematic diagrams of sampling points obtained at different sampling phases on the same input image. FIG. 2 has the correct sampling phase, while FIGS. 3 and 4 have wrong sampling phases. If Equation (1) is applied on FIGS. 2, 3 and 4, the image characteristic values thus obtained are, respectively:

$$\begin{aligned} C_1 &= \sum_{i=1}^{n} |P_{i+1} - P_i| \\ &= 0 + 0 + \Delta 1 + 0 + \Delta 1 + 0 + 0 \\ &= 2\Delta 1 \end{aligned}$$

$$\begin{aligned} C_2 &= \sum_{i=1}^{n} |P_{i+1} - P_i| \\ &= 0 + \Delta 2 + (\Delta 1 - \Delta 2) + (\Delta 1 - \Delta 3) + \Delta 3 + 0 + 0 \\ &= 2\Delta 1 \end{aligned}$$

-continued $$\begin{aligned} C_3 &= \sum_{i=1}^{n} |P_{i+1} - P_i| \\ &= 0 + \Delta 4 + (\Delta 1 - \Delta 4) + (\Delta 1 - \Delta 4) + \Delta 4 + 0 + 0 \\ &= 2\Delta 1 \end{aligned}$$

The image characteristic values are all 2Δ1. So there is no way to get the largest image characteristic value, and this method cannot find the correct sampling phase. Furthermore, when changing the time domain to the frequency domain for calculation, though a better precision can be obtained, yet the complicated conversion needed makes it hard to implement by hardware.

SUMMARY OF THE INVENTION

In view of the foregoing problems, it is an object of the present invention to provide a method with less complexity and easy to implement for phase adjustment, which can correctly set the sampling phase of the ADC in a LCD control system.

The instant invention discloses a method for automatically adjusting the sampling phase of a LCD control system, which is used to adjust the sampling phase of the ADC in the LCD control system. This method comprises the steps of:

setting a correct sampling frequency;

setting the range of sampling phases;

computing the image characteristic value C under different sampling phases using the following equation:

$$C = \sum_{i=0}^{n} |2P_i - P_{i-1} - P_{i+1}|$$

where i's are image points and Pi are the gray scale values of the corresponding image points; and comparing obtained image characteristic values and selecting the sampling phase with the largest image characteristic value as the correct sampling phase.

The method for automatically adjusting the sampling phase of a LCD control system uses a special function to obtain the image characteristic value. It can effectively and correctly set the sampling phase of the ADC in the LCD control system for the LCD to display clear images. In addition, for systems with large noise, this method can remove noisy signals from the lower bits with a mask register so as to increase the precision of the sampling phase adjustment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and advantages of the present invention will become apparent by reference to the following description and accompanying drawings wherein.

DETAILED DESCRIPTION OF THE INVENTION

Figure 1:
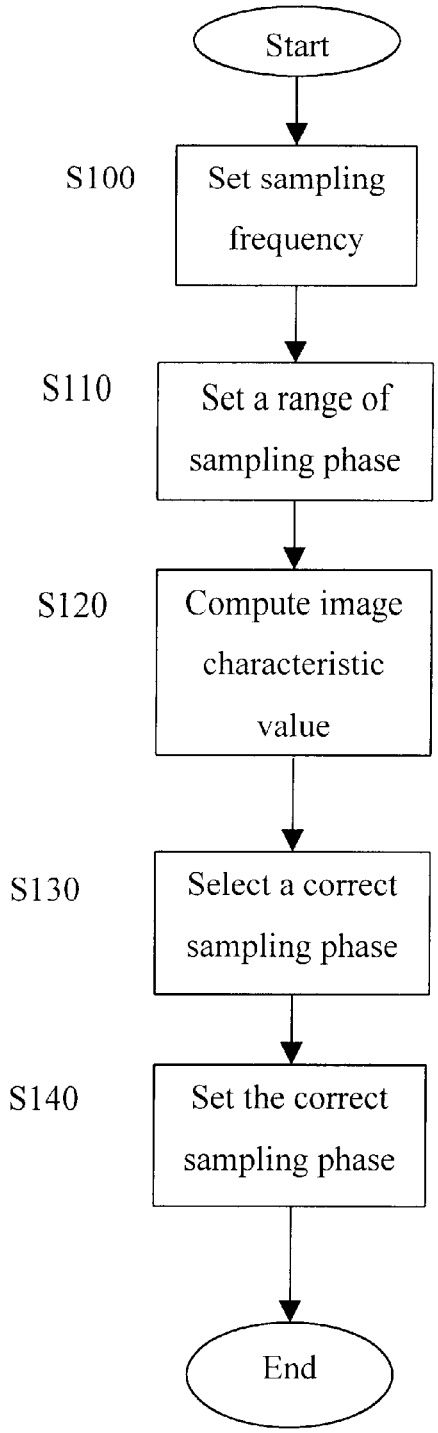
FIG. 1 is a flow chart of the method for automatically adjusting the sampling phase of a LCD control system according to the present invention.

This invention provides a method for automatically adjusting the sampling phase of a LCD control system, which is used to adjust the sampling phase of the ADC in the LCD control system. The correct sampling phase can be obtained by using this adjustment method. As shown in FIG. 1, the method comprises the steps of:

Step S100: setting a correct sampling frequency before adjusting the sampling phase (otherwise, the sampling phase adjustment would be affected);

Step S110: setting the range of the sampling phase;

Step S120: calculating the image characteristic value C under different sampling phases using Equation (2), $$C = \sum_{i=0}^{n} |2P_i - P_{i-1} - P_{i+1}| \tag{2}$$

where i's are image points and $P_i$ are the gray scale values of the corresponding image points; and Step 130: comparing all the image characteristic values and selecting the largest one;

Step 140: setting the sampling phase with the largest image characteristic value as the correct sampling phase.

Figure 2:
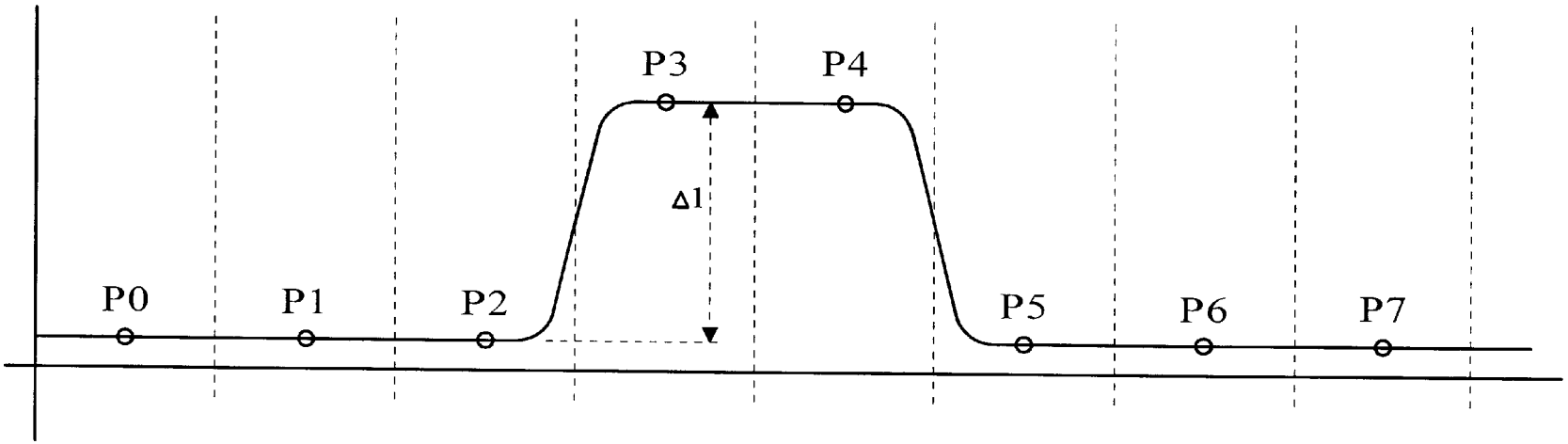
FIG. 2 shows the sampling point distribution when sampling input image signals at the correct phase.
Figure 3:
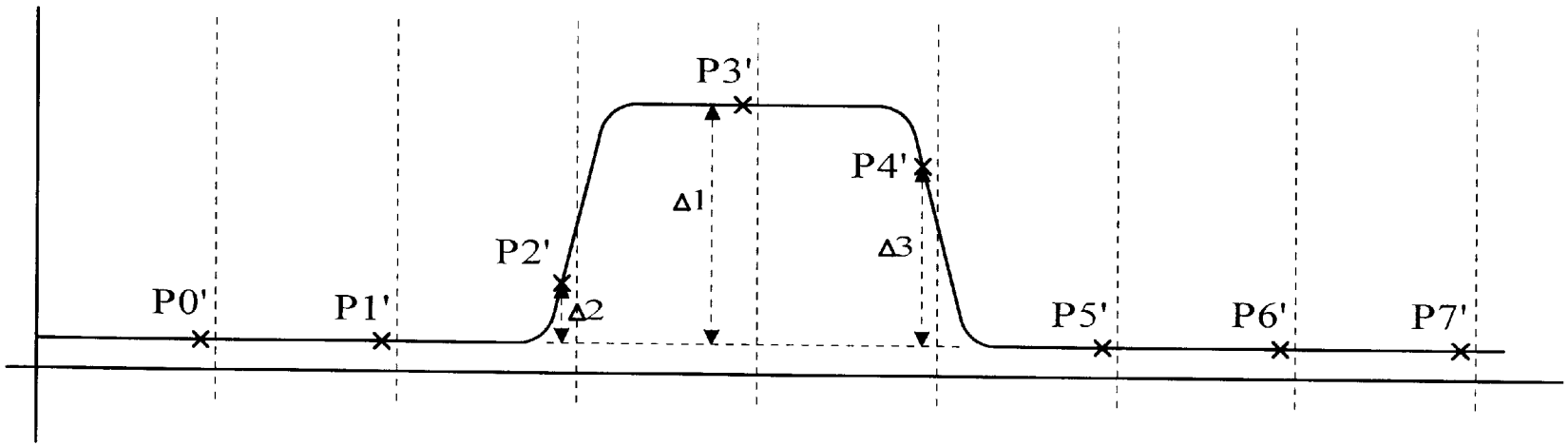
FIG. 3 shows the sampling point distribution when sampling input image signals at a wrong phase.
Figure 4:
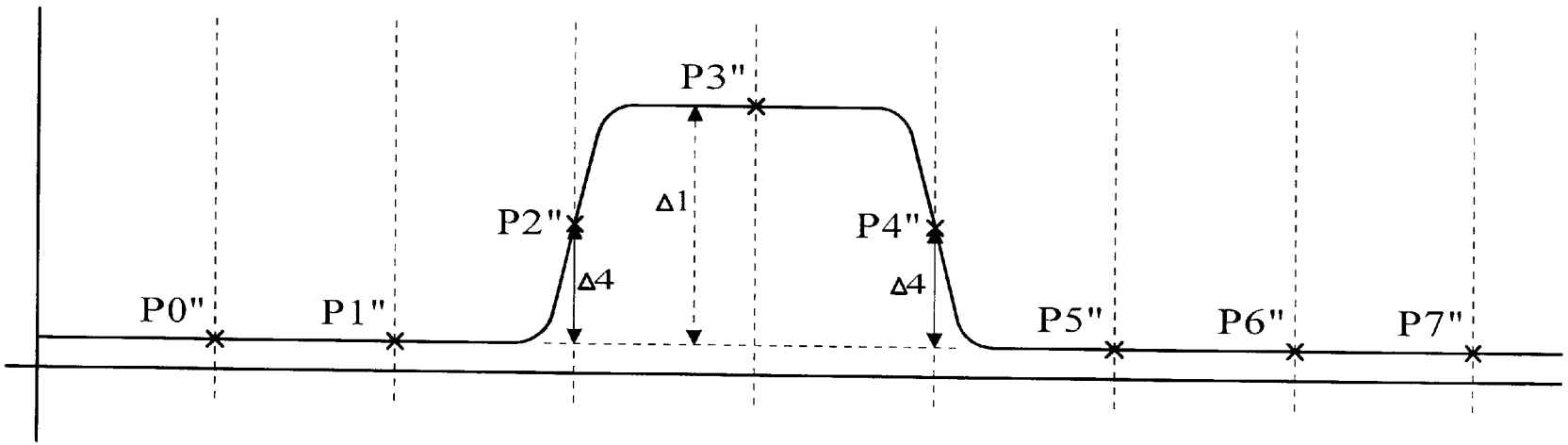
FIG. 4 shows the sampling point distribution when sampling input image signals at another wrong phase.

FIGS. 2 through 4 show the sampling point distribution when sampling input image signals at different sampling phases, wherein FIG. 2 shows the sampling points obtained at the correct sampling phase, while FIGS. 3 and 4 show those obtained by using incorrect sampling phases.

FIG. 2 shows the sampling points obtained from the input image signals at the correct sampling phase. Under this sampling method, the image characteristic value $C_1$ calculated using Equation (2) is:

$$\begin{aligned} C_1 &= \sum_{i=0}^{7} |2P_i - P_{i-1} - P_{i+1}| \\ &= 0 + 0 + \Delta 1 + \Delta 1 + \Delta 1 + \Delta 1 + 0 + 0 \\ &= 4\Delta 1 \end{aligned}$$

FIG. 3 shows the sampling points obtained from the input image signals at an incorrect sampling phase. Since the sampling phase is not correct, the sampling points do not fall in the middle region of the flat area and the sampling result causes flashing images. Under this sampling method, the image characteristic value $C_2$ calculated using Equation (2) is:

$$C_2 = \sum_{i=0}^{7} |2P_i - P_{i-1} - P_{i+1}|$$

-continued $$\begin{aligned} &= 0 + \Delta 2 + (\Delta 1 - 2\Delta 2) + (2\Delta 1 - \Delta 2 - \Delta 3) + (2\Delta 3 - \Delta 1) + \\ &\quad \Delta 3 + 0 + 0 \\ &= 2\Delta 1 - 2\Delta 2 + 2\Delta 3 \\ &= 3\Delta 1 \end{aligned}$$

where $\Delta 2 = (1/4)\Delta 1$, and $\Delta 3 = (3/4)\ \Delta 1$.

FIG. 4 shows the sampling points obtained from the input image signals at another incorrect sampling phase. Since the sampling phase is not correct, the sampling points do not fall in the middle region of the flat area and the sampling result causes flashing images. Under this sampling method, the image characteristic value $C_3$ calculated using Equation (2) is:

$$\begin{aligned} C_3 &= \sum_{i=0}^{7} |2P_i - P_{i-1} - P_{i+1}| \\ &= 0 + \Delta 4 + (\Delta 1 - 2\Delta 4) + (2\Delta 1 - \Delta 4 - \Delta 4) + (2\Delta 4 - \Delta 1) + \\ &\quad \Delta 4 + 0 + 0 \\ &= \Delta 4 + \Delta 1 - 2\Delta 4 + 2\Delta 1 - 2\Delta 4 + 2\Delta 4 - \Delta 1 + \Delta 4 \\ &= 2\Delta 1 \end{aligned}$$

where $\Delta 4 = (1/2)\Delta 1$

From the above characteristic values $C_1$, $C_2$, and $C_3$, one knows that $C_1 > C_2 > C_3$. Therefore, this method can get a largest image characteristic value and set the correct sampling phase.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for automatically adjusting the sampling phase of a LCD control system for used in adjusting the sampling phase of an ADC in said LCD control system, which method comprises the steps of:

setting a correct sampling frequency;

setting a range of the sampling phase;

computing the image characteristic value C under different sampling phases of said range using the following equation:

$$C = \sum_{i=0}^{n} |2P_i - P_{i-1} - P_{i+1}|$$

where i's are image points and $P_i$ are the gray scale values of said image points; and comparing said image characteristic value and selecting the sampling phase with the largest image characteristic value as the correct sampling phase.

* * * * *